US005511262A

United States Patent [19]

Horng

[11] Patent Number: 5,511,262

[45] Date of Patent: Apr. 30, 1996

[54] MULTI-FUNCTIONAL STATIONERY ASSEMBLY

[76] Inventor: Huey-Tsair Horng, No. 370, Sec. 3, Tay Her Road, Chang Hua City, Taiwan

[21] Appl. No.: 455,410

[22] Filed: May 31, 1995

[51] Int. Cl.[6] ..... B26B 11/00

[52] U.S. Cl. ..... 7/160; 30/123

[58] Field of Search ..... 7/158, 160, 167, 7/168, 170, 118, 119, 163; 30/123

[56] References Cited

U.S. PATENT DOCUMENTS 4,783,867 11/1988 Tsao ..... 7/160

4,794,692 1/1989 Wang ..... 30/123

*Primary Examiner*—D. S. Meislin

*Attorney, Agent, or Firm*—Beveridge, DeGrandi, Weilacher & Young

[57] ABSTRACT

A multi-functional stationery assembly has a scissors cover, a side cover of ball pen, a pen switch, a pen spring, a ball pen, a pen body, a curved spring plate, an art designing blade, a pair of scissors blades, an art designing knife body, a positioning plate, a side cover of art designing knife body, and a knife switch. The pen body which has the first scissors positioning plate is disposed on top of the side cover of ball pen. The art designing knife body which has the second scissors positioning plate is disposed on top of the first scissors positioning plate. The pen switch which is disposed between the side cover of ball pen and the pen body contains a push button at the front end, an elastic slit at the rear end, a protruded rod at the rear end and a snapping rod at the outer edge. The side cover of art designing knife is disposed on top of the art designing knife body which contains the second scissors positioning plate at the front end and a guidance recess in the upper surface of the middle and rear portion. The side cover of art designing knife is inserted in the guidance recess.

1 Claim, 4 Drawing Sheets

MULTI-FUNCTIONAL STATIONERY ASSEMBLY

BACKGROUND OF THE INVENTION

The invention relates to a multi-functional stationery. More particulary, the invention relates to a multi-functional stationery which contains a pair of scissors, a ball pen and an art designing knife.

Most students use a pair of scissors, ball pens and art designing knives separately. The three sets of scissors, ball pens and art designing knives occupy large room, and these articles may mix with other stationery articles so that they are not safe in use. Conventional scissors do not have any sheath to cover the scissors blade, so they are not safe and convenient in use. Some users try to use art designing knives instead of scissors. However, the function of art designing knives is different from that of scissors. Some designers try to combine the functions of ball pens and art designing knives together. However, the important function of scissors is omitted in most multi-functional stationery design. Because the combination of a pair of scissors, a ball pen and an art designing knife in an assembly is difficult, the inventor spends a long period to research and develop the multi-functional stationery assembly of the invention.

SUMMARY OF THE INVENTION

An object of the invention is to provide a multi-functional stationery assembly which overlaps a ball pen, a pair of scissors and an art designing knife in an assembly so that the user can use the assembly easily and conveniently.

Another object of the invention is to provide a multi-functional stationery assembly which contains a scissors cover to protect the user.

Yet another object of the invention is to provide a multi-functional stationery assembly which positions two scissors blades via two corresponding scissors plates so that one or two scissors blade can be changed if it is necessary.

Accordingly, a multi-functional stationery assembly has a scissors cover, a side cover of ball pen, a pen switch, a pen spring, a ball pen, a pen body, a curved spring plate, an art designing blade, a pair of scissors blades, an art designing knife body, a positioning plate, a side cover of art designing knife body, and a knife switch. The scissors cover has a scissors blade notch in front end and a clip on a top surface. The ball pen side cover has a slot therein, a small guidance extending from a rear portion of the slot, a plurality of protruded rods which are disposed on an upper periphery and a plurality of gaps which are formed at an outer surface of the ball pen side cover. The pen body which has a first scissors positioning plate at front portion thereon is disposed on top of the ball pen side cover. The art designing knife body which has a second scissors positioning plate at front portion thereon is disposed on top of the pen body. The pen switch which is disposed between the ball pen side cover and the pen body contains a push button at a front end, an elastic slit at a rear end, a protruded rod extending from a rear end and a snapping rod at an outer edge. The first and second scissors positioning plates are disposed in an opposite angle. The first handle extends from a rear portion of the first positioning plate. The second handle extends from a rear portion of the second positioning plate. The upper surface of the first positioning plate and the lower surface of the second positioning plate have corresponding round posts respectively. The upper, rear portion of the pen body has a first receiving recess. The lower, rear portion of the knife body has a second receiving recess. The pen outlet is formed at a rear end of the pen body. The first handle extends from the first scissors positioning plate. The blade outlet is formed at a rear end of the knife body. The large screw socket is disposed at a rear portion of the pen body and the small screw socket is disposed at a middle portion of the pen body. The lower middle portion of the pen body has a snapping notch. The upper surface of the second handle which extends from the second positioning plate has two cylindrical recesses with a plurality of holes, a guide rail crossing a central portion of the second handle, and a screw hole formed at a rear portion of the second handle. A recess groove is formed in front of the guide rail. The scissors cover which is a semi-cylindrical sheath has a scissors blade notch in an front end therein and a clip on a top surface thereon. A small guidance which is formed in a rear portion of the pen side cover extending from a slot which is formed on an upper surface of the cover. Each scissors blade has a plurality of circular holes to match corresponding round posts on the first and second scissors positioning plates. The side cover of art designing knife is disposed on top of the art designing knife body. The positioning plate which is disposed between the art designing knife body and the side cover of art designing knife has a round hole at a front end, a positioning block at a rear end and an elastic rod with a side block extending from an inner side of the positioning plate. The knife side cover matches and covers the cylindrical recess. The interior of the knife side cover has a plurality of angled grooves and protrusions. A cylindrical hole is formed in a front and middle portion of the knife side cover and a recess is formed in an upper portion of the cover. The rear end of the cover has a blade notch. The knife switch is disposed on top of the side cover of art designing knife.

DETAILED DESCRIPTION OF THE INVENTION

Figure 1:
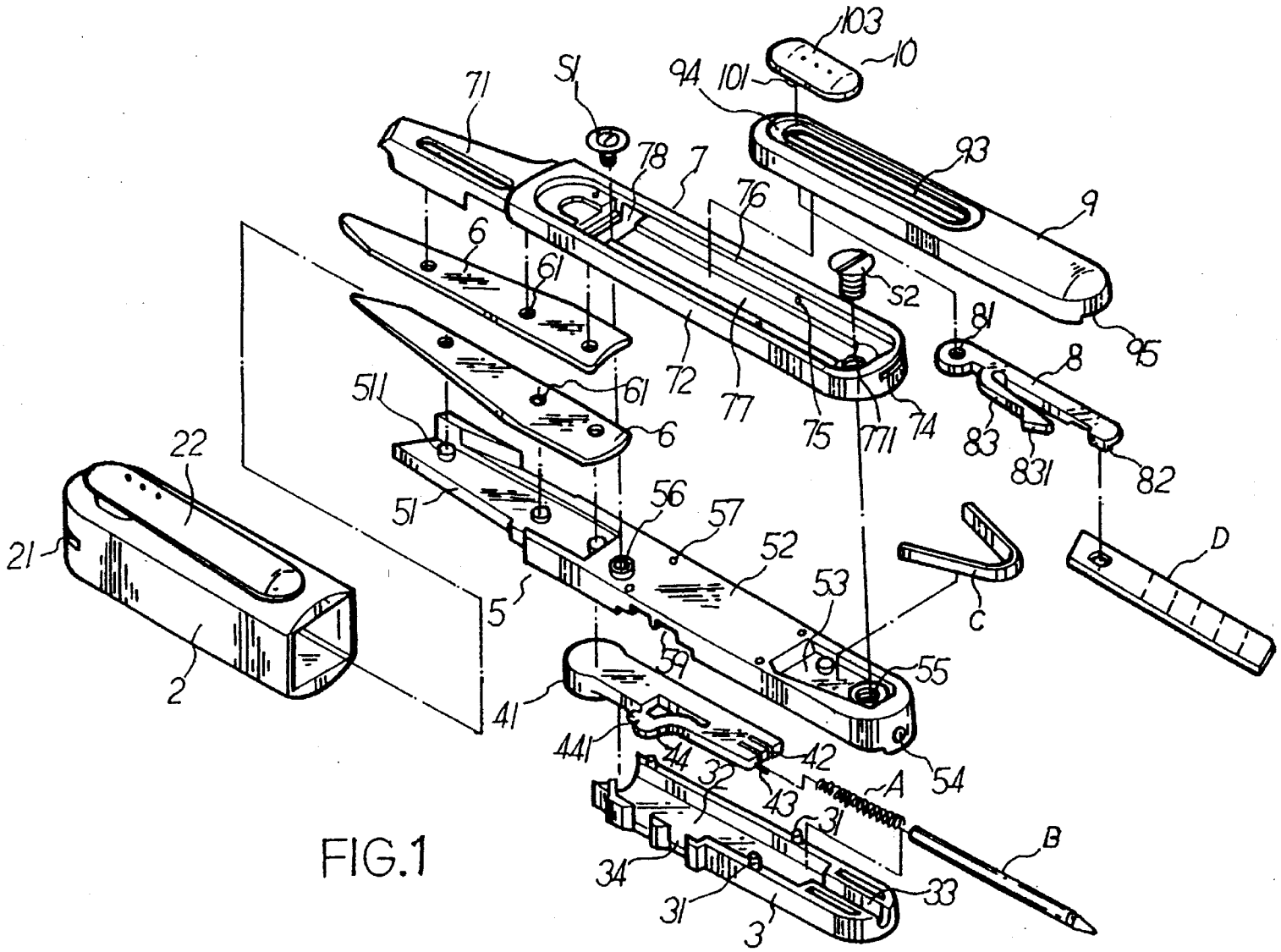
FIG. 1 is a perspective exploded view of a preferred embodiment in accordance with the invention.

Referring to FIG. 1, a multi-functional stationery assembly has a scissors cover 2, a side cover 3 of ball pen, a pen switch 4, a pen spring A, a ball pen B, a pen body 5, a curved spring plate C, an art designing blade D, a pair of scissors blades 6, an art designing knife body 7, a positioning plate 8, a round head screw S1, a flat head screw S2, a side cover 9 of art designing knife body, and a knife switch 10. The first scissors positioning plate 51 and the second scissors positioning plate 71 are disposed in an opposite angle. The first handle 52 extends from the rear portion of the first positioning plate 51. The second handle 72 extends from the rear portion of the second positioning plate 71 also. The upper surface of the first positioning plate 51 and the lower surface of the second positioning plate 71 have corresponding round posts 511 and 711 respectively. The upper, rear portion of the pen body 5 has a first receiving recess 53 and the lower rear portion of the knife body 7 has a second receiving recess 73 also. The two receiving recesses 53 and 73 are in an opposite angle. A pen outlet 54 is formed at the rear end of the pen body 5. A blade outlet 74 is formed at the rear end of the knife body 7. A large screw socket 55 is disposed at the rear portion of the pen body 5 and a small screw socket 56 is disposed at the middle portion of the pen body 5. A plurality of small holes 57 are formed in the predetermined positions. The lower middle portion of the pen body 5 has a snapping notch 59. The upper surface of the second handle 72 has two cylindrical recesses 76 with a plurality of holes 75, a guide rail 77 crosses the central portion of the second handle 72, and a screw hole which is formed at the rear portion of the second handle 72. A recess groove 78 is formed in front of the guide rail 77. The scissors cover 2 which is a semi-cylindrical sheath has a scissors blade notch 21 in the front end and a clip 22 on the top surface. The length of the pen side cover 3 is smaller than that of the first handle 52. A small guidance 33 which is formed in the rear portion of the pen side cover 3 extends from the slot 32 which is formed on the upper surface of the cover 3. The outer periphery of the pen side cover 3 has a few protruded rods 31 and a few gaps 34. The pen switch 4 contains a push button 41 at the front end and an elastic slit 42 at the rear end. The rear end of the pen switch 4 has a protruded rod 43. The outer edge of the pen switch 4 has a snapping rod 44 with a breach 441. Each scissors blade 6 has a plurality of circular holes 61 to match the corresponding round posts 511 and 711. The positioning plate 8 has a round hole 81 at its front end, a positioning block 82 at its rear end and an elastic rod 83 with a side block 831 extending from the inner side of the positioning plate 8. The knife side cover 9 matches and covers the cylindrical-recess 76. The interior of the side cover 9 has a plurality of angled grooves 91 and protrusions 92. A cylindrical hole 93 is formed in the front and middle portion of the knife side cover 9, and a recess 94 is formed in the upper portion of the cover 9. The rear end of the cover 9 has a blade notch 95. The knife switch 10 which has an elastic snapping post 101 and a guide rail 102 at the lower surface contains a movable plate 103. The knife switch 10 is disposed on top of the cylindrical hole 93.

Figure 2:
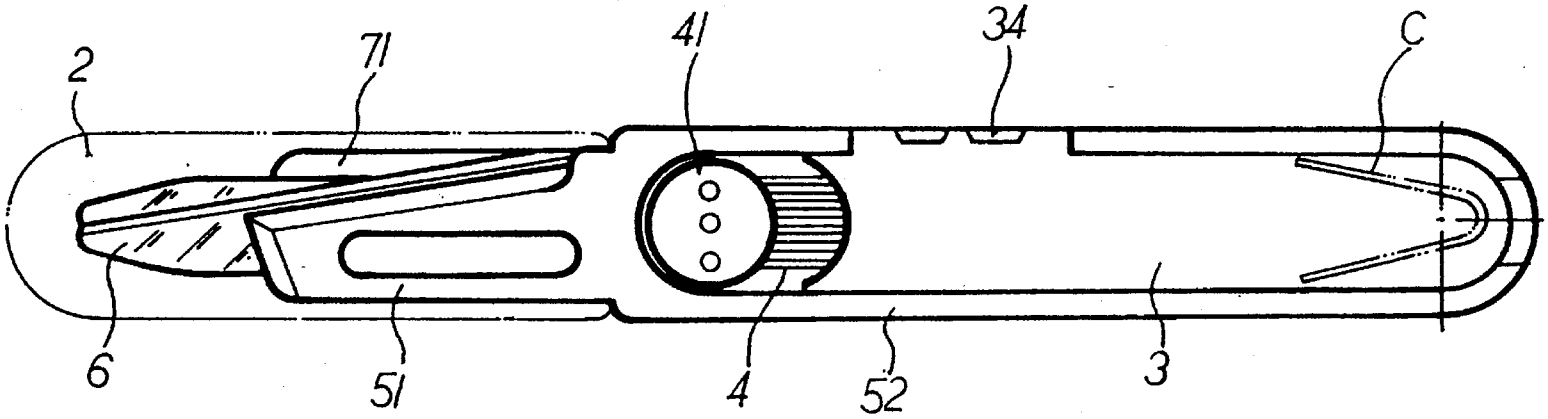
FIG. 2 is a schematic view of the invention while the scissors are not in use.
Figure 2A:
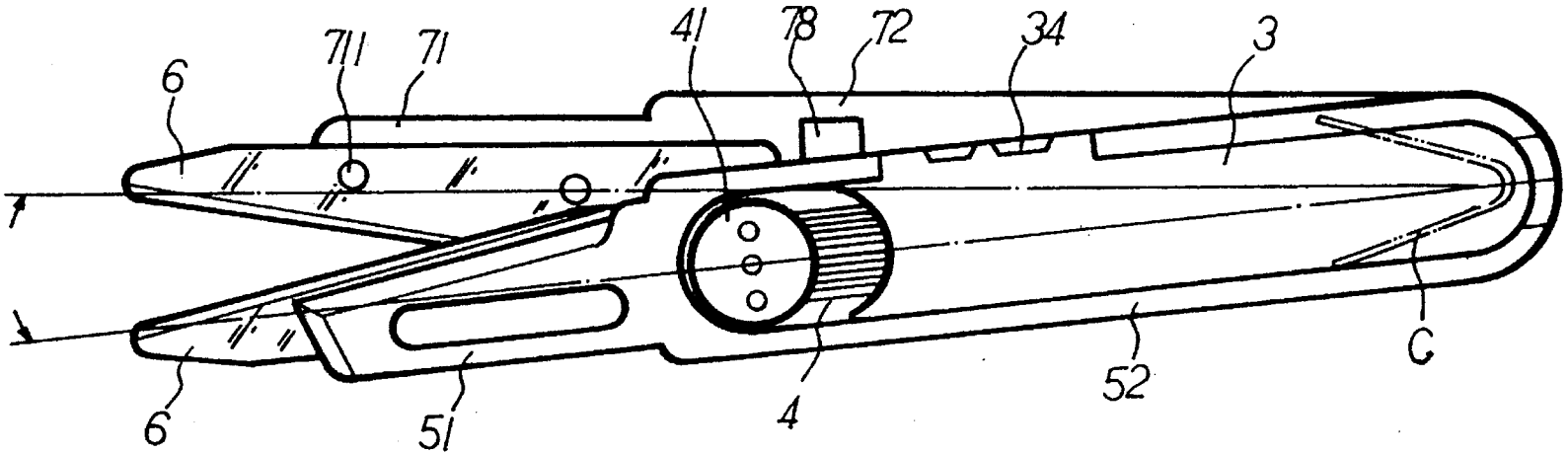
FIG. 2A is a schematic view of the invention while the scissors are in use.
Figure 3:
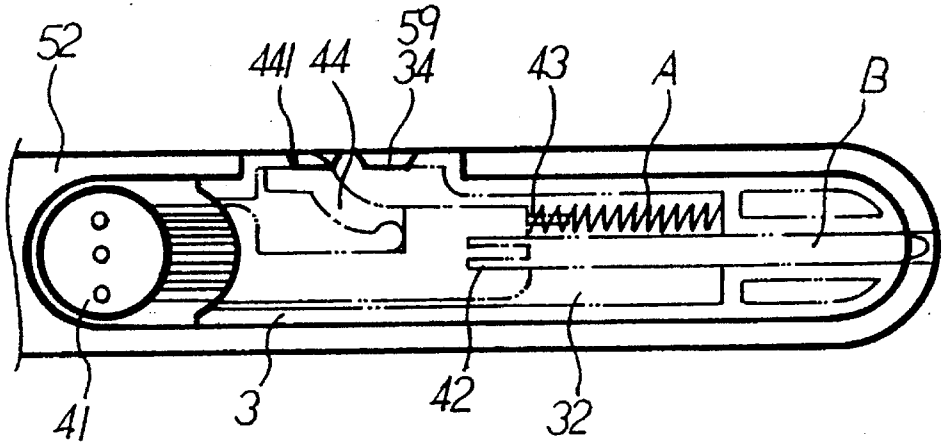
FIG. 3 is a schematic view of the invention while the ball pen is not in use.
Figure 3A:
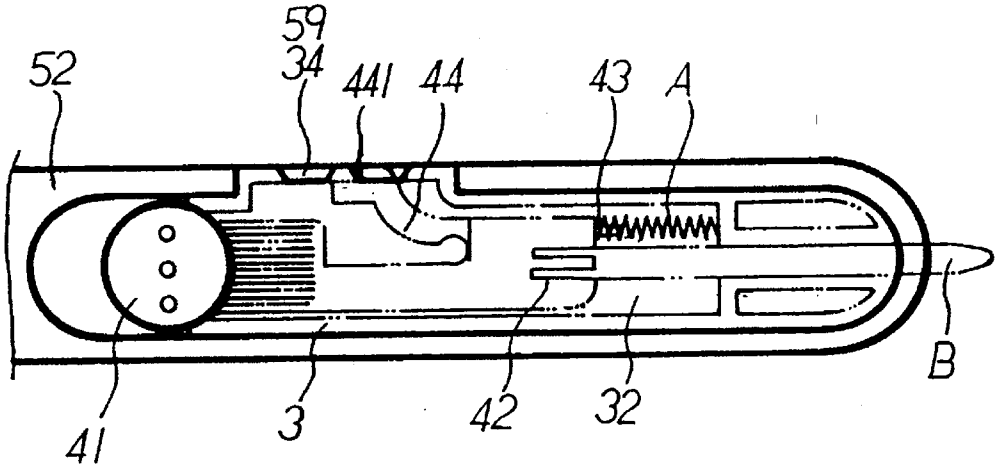
FIG. 3A is a schematic view of the invention while the ball pen is in use.
Figure 4A:
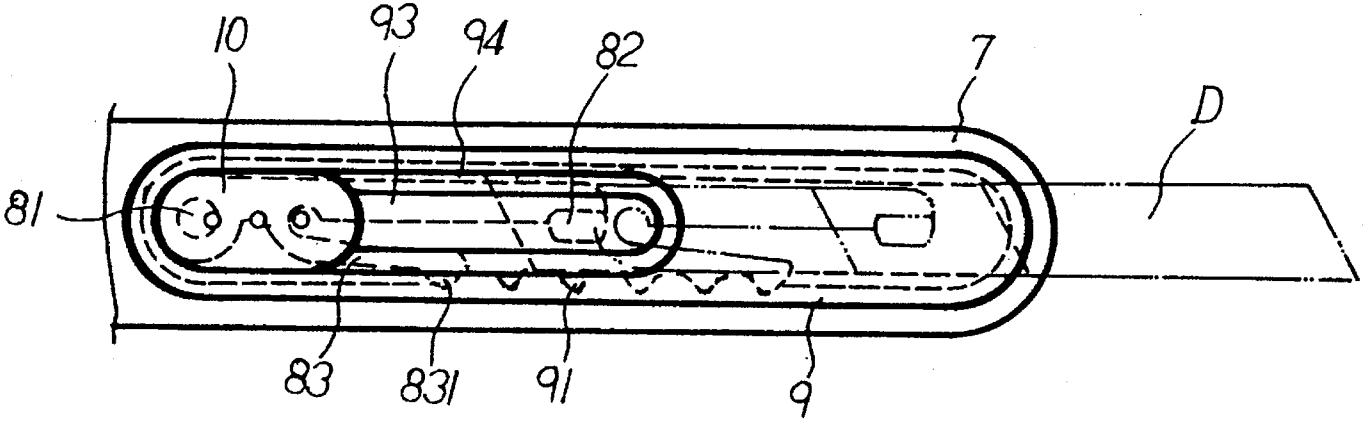
FIG. 4A is a schematic view of the invention while the art designing knife is in use.
Figure 4:
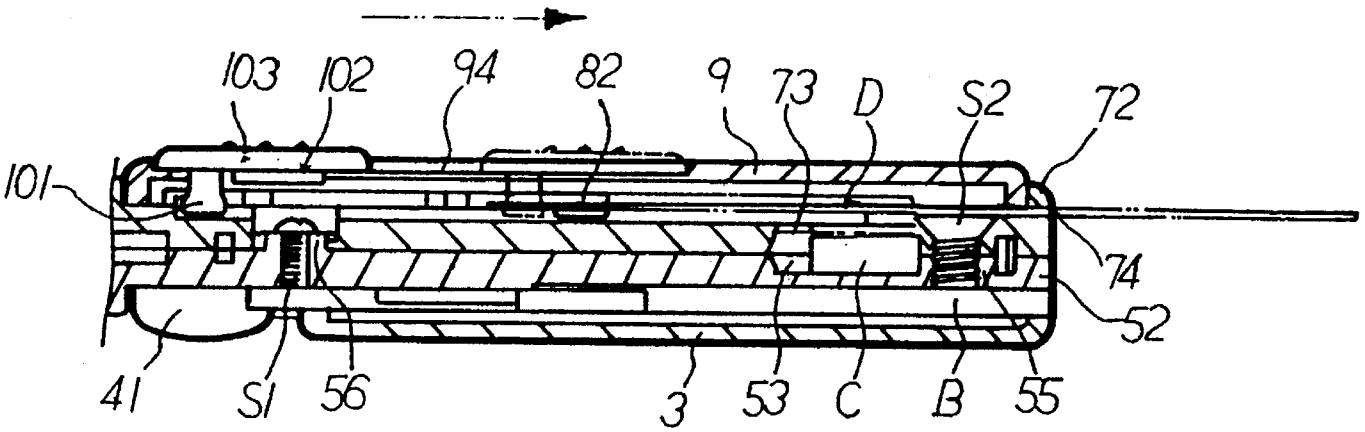
FIG. 4 is a cross sectional view of the art designing knife of the invention.

In combination, the spring plate C is disposed between the receiving recesses 53 and 73. While the screws S1 and S2 are screwed into the corresponding screw sockets 56 and 55, the pen body 5 and the knife body 7 are combined together. The scissors plates 6 are fastened by the corresponding posts 511 and 711. Referring to FIG. 2, the scissors cover 2 covers the first and second scissors positioning plates 51 and 71 so that the overlap of the scissors blades 6 is less than a predetermined angle. Referring to FIG. 2A, the scissors cover 2 is removed so that the scissors are in operation. FIGS. 3 and 3A illustrate the inoperation and operation states of the ball pen. Referring to FIGS. 4 and 4A, the knife switch 10 is moved forwardly or rearwardly in order to operate or inoperate the art designing blade D.

The invention is not limited to the above embodiment but various modification thereof may be made. It will be understood by those skilled in the art that various changes in form and detail may be made without departing from the spirit and scope of the invention.

What is claimed is:

1. A multi-functional stationery assembly comprising:

a scissors cover having a scissors blade notch in front end and a clip on a top surface;

a ball pen side cover having a slot therein, a small guidance extending from a rear portion of said slot, a plurality of protruded rods disposed on an upper periphery and a plurality of gaps formed at an outer surface of said ball pen side cover;

a pen body which has a first scissors positioning plate at front portion thereon disposed on top of said ball pen side cover:

an art designing knife body which has a second scissors positioning plate at front portion thereon disposed on top of said pen body;

a pen switch which is disposed between said ball pen side cover and said pen body containing a push button at a front end, an elastic slit at a rear end, a protruded rod extending from a rear end and a snapping rod at an outer edge;

said first and second scissors positioning plates being disposed in an opposite angle;

a first handle extending from a rear portion of said first positioning plate;

a second handle extending from a rear portion of said second positioning plate;

an upper surface of said first positioning plate and a lower surface of said second positioning plate having corresponding round posts respectively;

an upper, rear portion of said pen body having a first receiving recess;

a lower, rear portion of said knife body having a second receiving recess;

a pen outlet being formed at a rear end of said pen body;

a first handle extending from said first scissors positioning plate;

a blade outlet being formed at a rear end of said knife body;

a large screw socket being disposed at a rear portion of said pen body and a small screw socket being disposed at a middle portion of said pen body;

a lower middle portion of said pen body having a snapping notch;

an upper surface of a second handle which extends from said second positioning plate having two cylindrical recesses with a plurality of holes, a guide rail crossing a central portion of said second handle, and a screw hole formed at a rear portion of said second handle;

a recess groove being formed in front of said guide rail;

a scissors cover which is a semi-cylindrical sheath having a scissors blade notch in an front end therein and a clip on a top surface thereon;

a small guidance which is formed in a rear portion of said pen side cover extending from a slot which is formed on an upper surface of said cover;

each scissors blade having a plurality of circular holes to match corresponding round posts on said first and second scissors positioning plates;

a side cover of art designing knife being disposed on top of said art designing knife body;

a positioning plate which is disposed between said art designing knife body and said side cover of art designing knife having a round hole at a front end, a positioning block at a rear end and an elastic rod with a side block extending from an inner side of said positioning plate;

said knife side cover matching and covering said cylindrical recess;

an interior of said knife side cover having a plurality of angled grooves and protrusions;

a cylindrical hole being formed in a front and middle portion of said knife side cover and a recess being formed in an upper portion of said cover;

a rear end of said cover having a blade notch;

a knife switch being disposed on top of said side cover of art designing knife.

* * * * *